US009788633B2

(12) United States Patent
Jung

(10) Patent No.: US 9,788,633 B2
(45) Date of Patent: Oct. 17, 2017

(54) EXTRUSION TYPE COSMETIC CONTAINER

(71) Applicant: YONWOO CO., LTD., Incheon (KR)

(72) Inventor: Hyo-Sun Jung, Incheon (KR)

(73) Assignee: YONWOO CO., LTD., Incheon (KR)

( * ) Notice: Subject to any disclaimer, the term of this patent is extended or adjusted under 35 U.S.C. 154(b) by 0 days.

(21) Appl. No.: 14/900,470

(22) PCT Filed: Jun. 23, 2014

(86) PCT No.: PCT/KR2014/005501
§ 371 (c)(1),
(2) Date: Dec. 21, 2015

(87) PCT Pub. No.: WO2014/208945
PCT Pub. Date: Dec. 31, 2014

(65) Prior Publication Data

US 2016/0150868 A1 Jun. 2, 2016

(30) Foreign Application Priority Data

Jun. 25, 2013 (KR) ..... 10-2013-0072851

(51) Int. Cl.
*A45D 34/04* (2006.01)
*A45D 40/00* (2006.01)
(Continued)

(52) U.S. Cl.
CPC ..... *A45D 40/0075* (2013.01); *A45D 34/04* (2013.01); *B65D 83/0094* (2013.01); *A45D 40/023* (2013.01); *A45D 2200/055* (2013.01)

(58) Field of Classification Search
CPC ..... G01F 11/288; B67D 7/60; B65B 7/14; B65D 35/08; B65D 35/10; B65D 35/12; B65D 83/0094
(Continued)

(56) References Cited

U.S. PATENT DOCUMENTS 2,763,405 A * 9/1956 Shvetz ..... A45D 40/0075 222/320
3,249,265 A * 5/1966 Wershaw ..... A45D 40/0075 222/320
(Continued)

FOREIGN PATENT DOCUMENTS

JP H09-169372 A 6/1997
JP 2003-205953 A 7/2003
(Continued)

OTHER PUBLICATIONS

International Search Report issued in PCT/KR2014/005501 dated Jul. 17, 2014.

*Primary Examiner* — Patrick M Buechner
*Assistant Examiner* — Andrew P Bainbridge
(74) *Attorney, Agent, or Firm* — Marshall, Gerstein & Borun LLP

(57) ABSTRACT

The present invention relates to an extrusion-type cosmetic container, which discharges a desired amount of contents by a simple structure, by being configured so that the content extruding member descends and pressurizes contents contained in the cosmetic container and thus contents are discharged to the top surface of the content extruding member when a user pressurizes the upper end of the content extruding member by his/her hand.

1 Claim, 3 Drawing Sheets

(51) Int. Cl.
*B65D 83/00* (2006.01)
*A45D 40/02* (2006.01)

(58) Field of Classification Search
USPC .... 222/105–107, 380, 381, 383.1, 386, 540, 222/405, 207, 212, 406, 320
See application file for complete search history.

(56) References Cited

U.S. PATENT DOCUMENTS

| | | | | |
|---|---|---|---|---|
| 4,946,076 | A * | 8/1990 | Hackmann | B05B 11/0048 222/207 |
| 8,556,131 | B2 * | 10/2013 | Decottignies | A45D 40/0075 222/256 |
| 8,887,665 | B2 * | 11/2014 | Rocker | A01K 5/0128 119/61.2 |
| 2008/0054024 | A1 * | 3/2008 | Kubota | B65D 83/0044 222/386.5 |
| 2008/0169312 | A1 * | 7/2008 | Kee | B05B 11/0048 222/205 |
| 2011/0163129 | A1 * | 7/2011 | Wang | A45D 34/04 222/319 |
| 2011/0297704 | A1 | 12/2011 | Esteve et al. | |

FOREIGN PATENT DOCUMENTS

| | | | |
|---|---|---|---|
| KR | 20-0363983 | Y1 | 10/2004 |
| KR | 10-1146213 | B1 | 5/2012 |

* cited by examiner

[Fig. 1]
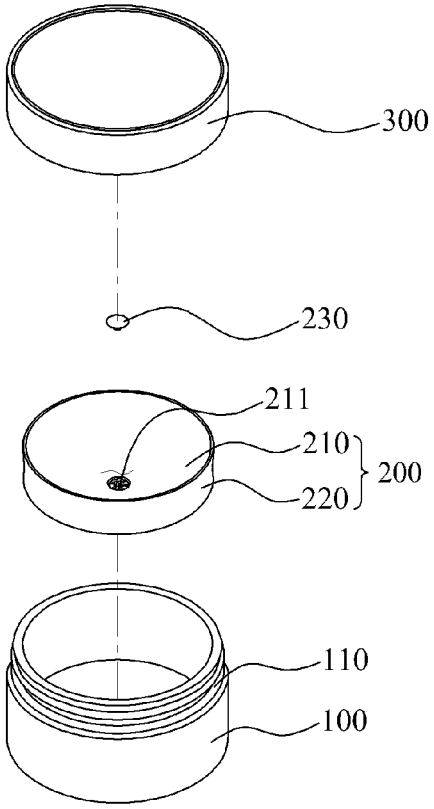
[Fig. 2]
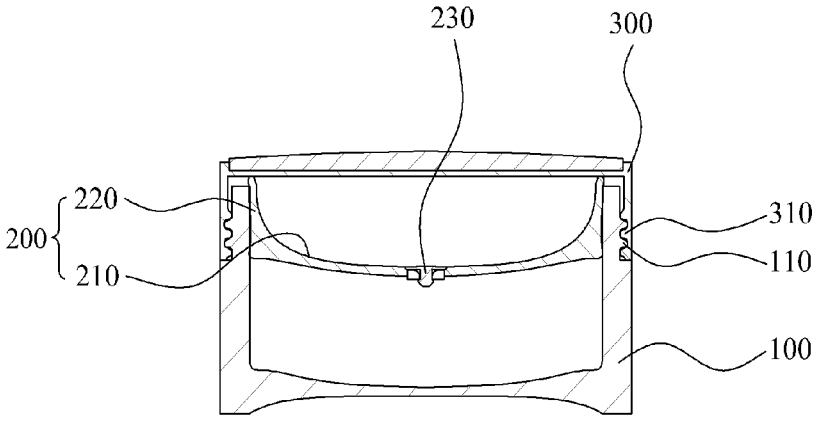

[Fig. 3]
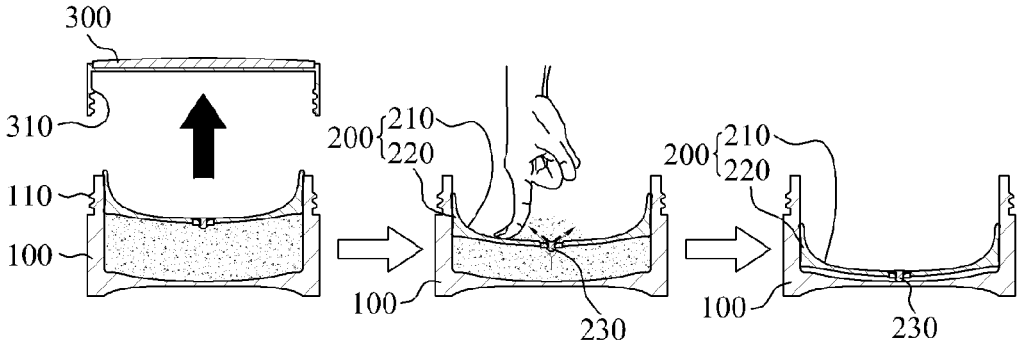
[Fig. 4]
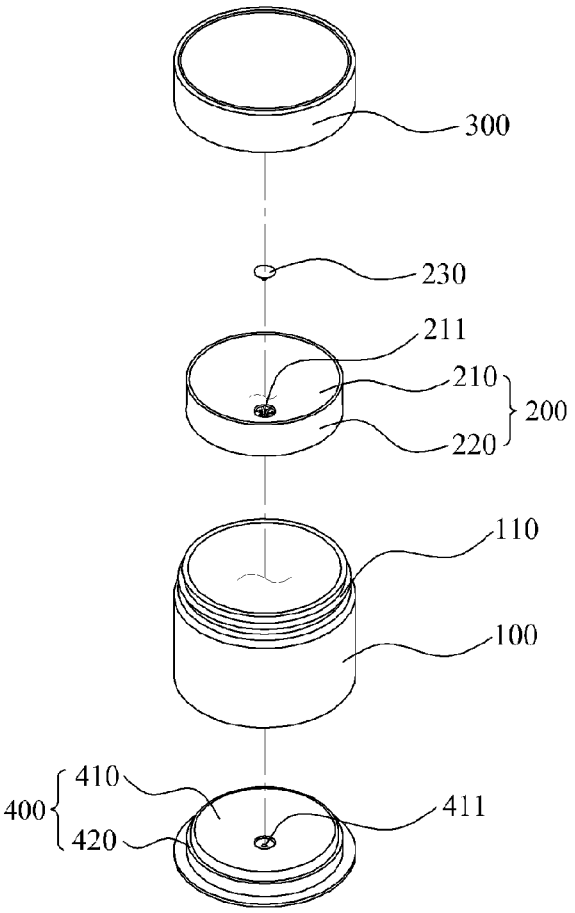

[Fig. 5]
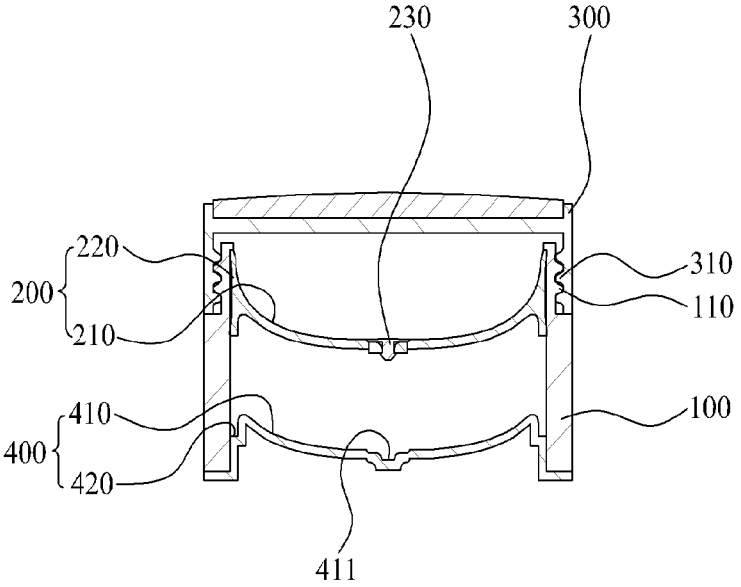
[Fig. 6]
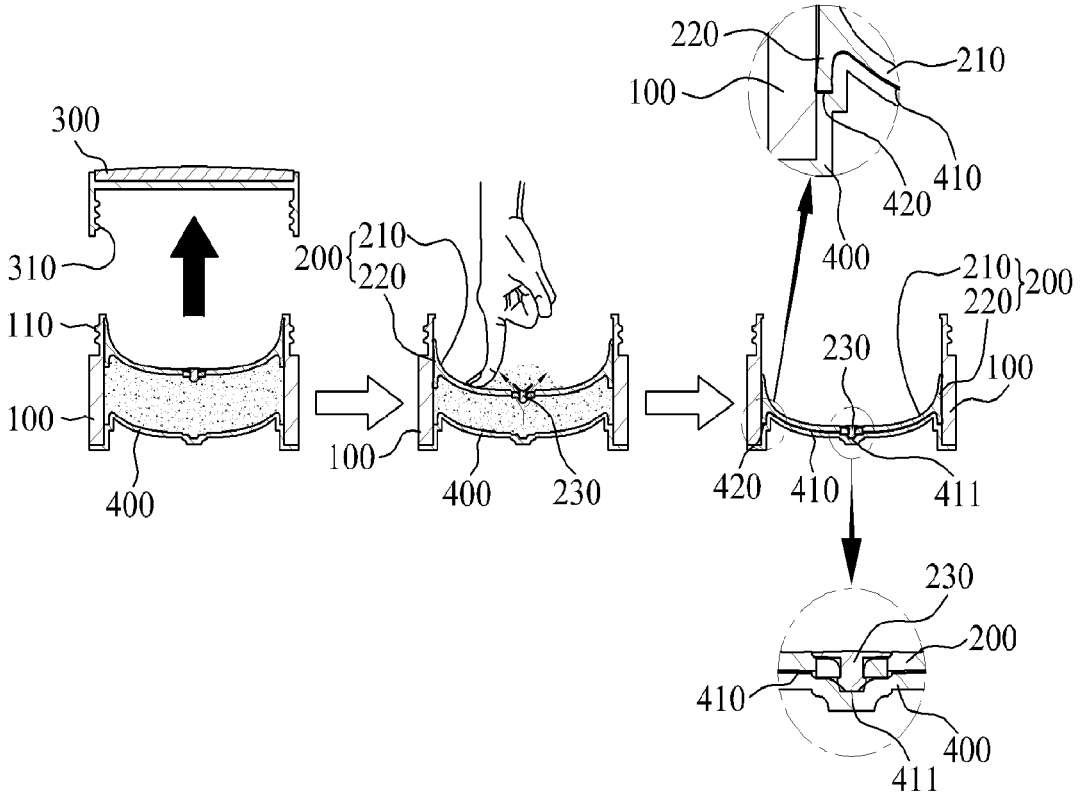

EXTRUSION TYPE COSMETIC CONTAINER

CROSS-REFERENCE TO RELATED APPLICATIONS

This U.S. utility patent application is a national stage application under 35 U.S.C. §371 of international application PCT/KR2014/005501, filed Jun. 23, 2014, and claims the benefit of priority under 35 U.S.C. §119 of Korean Patent Application No. 10-2013-0072851, filed Jun. 25, 2013, the entire contents of which are hereby incorporated herein by reference for all purposes.

BACKGROUND

The present invention disclosed herein relates to an extrusion-type cosmetic container, and more particularly, to an extrusion-type cosmetic container, which discharges a desired amount of contents by a simple structure, by being configured so that the content extruding member descends and pressurizes contents contained in the cosmetic container and thus contents are discharged to the top surface of the content extruding member when a user pressurizes the upper end of the content extruding member by his/her hand.

Generally, since cream-type of cosmetics such as nourishing cream, massage cream, eye cream or foundation have much oil content, it is well-known that they are easily corrupted compared to low viscosity cosmetics such as toner or lotion. As these cream-type cosmetics are provided while being held in a container having a relatively wide mouth so as to be drawn off on the hand for use, there is high probability of being oxidized due to contact with air and being contaminated with foreign substances or moisture on hand.

In order to supplement these limitations, cosmetic containers provided with a vacuum pump so that contents can be uniformly discharged while being sealed are being widely distributed, but there are limitations in that their structures become complicated and the manufacturing cost increases in order to form the vacuum pump and a button member for operating the vacuum pump.

In order to overcome the above-mentioned limitations, Korean Utility Model No. 20-0448112 discloses "cosmetic container of discharging fixed amount of high-viscosity contents", which can discharge contents by an extrusion method instead of a vacuum pump. In Korean Utility Model No. 20-0448112, when a user pressurizes a push member-combined cap 30, the container is configured to apply pressure to contents stored in a content holding part 18 of a inner body 15 while interlocking with a piston 20 and thus discharge contents out of an outlet 12 through a content transfer path 19.

However, Korean Utility Model No. 20-0448112 has a structure in which a space storing contents and a space discharging contents are separated from each other. Here, the structure of the container is complicated in that the content transfer path 19 is formed in the inner body 15 so as to enable contents to be discharged to the outlet 12 formed in an outer body 11 in order to discharge contents by an extrusion method. Also, since contents held in the content holding part 18 need to upwardly move to the outlet 12 through the content transfer pat 19 when the push member-combined cap 30 is pressurized to use contents for the first time, a user needs to apply a great force to discharge contents for the first time, thereby causing inconvenience.

SUMMARY

The present invention provides an extrusion-type cosmetic container, which discharges a desired amount of contents by a simple structure, by being configured so that the content extruding member descends and pressurizes contents contained in the cosmetic container and thus contents are discharged to the top surface of the content extruding member when a user pressurizes the upper end of the content extruding member by his/her hand.

The present invention also provides an extrusion-type cosmetic container, which can prevent contents from being corrupted and suddenly discharged, by interrupting introduction of air at normal times because a rubber tip is disposed in an outlet hole to seal the outlet hole at normal times and the outlet hole is opened by the pressure of contents only when contents are discharged.

Embodiments of the present invention provide extrusion-type cosmetic containers including: a container body storing contents; a content extruding member disposed over contents inside the container body, descending by pressurization of a user while adhering closely to an inner circumferential surface of the container body, and having an outlet hole for discharging contents stored in the container body; and a cap coupled to an upper portion of the container body to cover the container body.

In some embodiments, the extrusion-type cosmetic container may further include a support coupled to a lower portion of the container body and closing a lower end portion of the container body that is opened.

In other embodiments, the support may include an upper end portion thereof formed to have a shape corresponding to a lower end portion of the content extruding member so as to make contact with a whole of the lower end portion of the content extruding member when the content extruding member descends to a bottom surface of the container body.

In still other embodiments, the content extruding member may include: a recessed part having a dish-like shape, an upper end portion of which is recessed in a downward direction so that contents are discharged to a top surface of the recessed part; and a pressure changing part changing an internal pressure of the container body when the content extruding member descends in accordance with the pressurization of a user.

In even other embodiments, the content extruding member may include a rubber tip opening the outlet hole by the pressure of contents.

In yet other embodiments, the support may include: a first seating part, wherein the recessed part is seated, having a seating groove formed on a central portion of the first seating part so that a lower end of the rubber tip is seated on the seating groove; and a second seating part, formed surrounding an outer circumferential surface of the first seating part, wherein a lower end portion of the pressure changing part is seated.

As described above, an extrusion-type cosmetic container can discharge a desired amount of contents by a simple structure, by being configured so that the content extruding member descends and pressurizes contents contained in the cosmetic container and thus contents are discharged to the top surface of the content extruding member when a user pressurizes the upper end of the content extruding member by his/her hand.

Also, the extrusion-type cosmetic container can prevent contents from being corrupted and suddenly discharged, by interrupting introduction of air at normal times because a rubber tip is disposed in an outlet hole to seal the outlet hole at normal times and the outlet hole is opened by the pressure of contents only when contents are discharged.

In addition, since the extrusion-type cosmetic container is configured so that the shapes of the lower end of the content extruding member and the lower end of the support correspond to each other, the quantity of contents remaining in the container body when the content extruding member moves downward up to the lowermost portion can be minimized.

BRIEF DESCRIPTION OF THE DRAWINGS

FIG. 1 is an exploded perspective view illustrating a configuration of an extrusion-type cosmetic container according to an exemplary embodiment of the present invention;

FIG. 2 is a cross-sectional view illustrating a configuration of an extrusion-type cosmetic container according to an exemplary embodiment of the present invention;

FIG. 3 is a view illustrating a method of using an extrusion-type cosmetic container according to an exemplary embodiment of the present invention;

FIG. 4 is an exploded perspective view illustrating a configuration of an extrusion-type cosmetic container according to another exemplary embodiment of the present invention;

FIG. 5 is a cross-sectional view illustrating a configuration of an extrusion-type cosmetic container according to another exemplary embodiment of the present invention; and FIG. 6 is a view illustrating a method of using an extrusion-type cosmetic container according to another exemplary embodiment of the present invention.

DETAILED DESCRIPTION

Hereinafter, exemplary embodiments of the present invention will be described in detail with reference to the accompanying drawings. The same reference numerals provided in the drawings indicate the same members.

FIG. 1 is an exploded perspective view illustrating a configuration of an extrusion-type cosmetic container according to an exemplary embodiment of the present invention. FIG. 2 is a cross-sectional view illustrating a configuration of an extrusion-type cosmetic container according to an exemplary embodiment of the present invention.

Referring to FIGS. 1 and 2, an extrusion-type cosmetic container according to an exemplary embodiment of the present invention may include a container body 100, a content extruding member 200, and a cap 300.

The container body 100 may contain contents, and may have a thread formed on the outer circumferential surface thereof so that an upper portion of the container body 100 can be screw-coupled to the cap 300.

The content extruding member 200 may be located over contents inside the container body 100, and may discharge contents by pressurizing contents by a user. The content extruding member 200 may include a recessed part 210 and a pressure changing part 220.

The recessed part 210 may have a dish-like shape, the upper end portion of which is recessed in a downward direction so that contents are discharged to the top surface of the recessed part 210. The recessed part 210 may have an outlet hole 211 formed on the central portion of the recessed part 210 so that contents stored in the container body 100 are pressurized by the descent of the content extruding member 200 and discharged through the outlet hole 211.

On the other hand, a rubber tip 230 may be disposed to interrupt air from being introduced into the container body by closing the outlet hole 211 at normal times and to open the outlet hole 211 by the pressure of contents moving upward when the content extruding member 200 moves downward.

The pressure changing part 220 may change the internal pressure of the container body 100 when the content extruding member 200 descends in accordance with the pressurization of a user, and may be configured to descend while adhering closely to the inner wall of the container body 100 so as to enable the internal pressure of the container body 100 to change.

Since the pressure changing part 220 is configured to descend while adhering closely to the inner wall of the container body 100, contents stored in the container body 100 may be guided to the outlet hole 211, and may be allowed to pass through the outlet hole 211.

The cap 300 may cover the container body 100, and may be coupled to the upper portion of the container body 100. The cap 300 may prevent foreign substances from being introduced into the upper end of the recessed part 210 to which contents are discharged, and may have a second screw thread 310 formed on the inner circumferential surface thereof so as to be screw-coupled to a first screw thread 110 of the container body 100.

Hereinafter, an extrusion-type cosmetic container according to an exemplary embodiment of the present invention will be described with reference to FIG. 3. FIG. 3 is a view illustrating a method of using an extrusion-type cosmetic container according to an exemplary embodiment of the present invention.

Hereinafter, the operation of an extrusion-type cosmetic container according to an exemplary embodiment of the present invention will be described with reference to FIG. 3.

A user may pressurize the upper end portion of the recessed part 210 of the content extruding member 200 by his/her hand. In this case, the pressurization of the recessed part 210 may be simply performed by one finger of a user, but may be performed by two fingers so that a uniform pressure can be applied to both sides based on the outlet hole 211.

When the upper end of the recessed part 210 is pressurized, the content extruding member 200 may descend. In this case, the pressure changing part 220 may descend while adhering closely to the inner wall of the container body, and the internal pressure of the container body 100 may change, allowing contents stored in the container body 100 to be discharged through the outlet hole 211.

Thus, contents may be discharged to the top surface of the recessed part 210 having a dish shape through the outlet hole 211, and a user can use contents on the top surface of the recessed part 210 with hand or other coating members.

Hereinafter, an extrusion-type cosmetic container according to another exemplary embodiment of the present invention will be described with reference to FIGS. 4 to 6.

FIG. 4 is an exploded perspective view illustrating a configuration of an extrusion-type cosmetic container according to another exemplary embodiment of the present invention. FIG. 5 is a cross-sectional view illustrating a configuration of an extrusion-type cosmetic container according to another exemplary embodiment of the present invention. FIG. 6 is a view illustrating a method of using an extrusion-type cosmetic container according to another exemplary embodiment of the present invention.

Referring to FIGS. 4 to 6, an extrusion-type cosmetic container according to another exemplary embodiment of the present invention may include a container body 100, a content extruding member 200, a cap 300, and a support 400.

Since the container body 100, the content extruding member 200, and the cap 300 are similar to those described in the previous embodiment, detailed descriptions thereof will be omitted, and the explanation will be focused on the structure of the support 400.

The support 400 may be coupled to a lower portion of the container body 100 to seal the lower end portion of the container body 100 which is opened. The upper end portion of the support 400 may have a shape corresponding to the shape of the lower end portion of the content extruding member 200 so as to contact the whole of the lower end portion of the content extruding member 200 when the content extruding member 200 descends to the bottom surface of the container body 100.

For this, as shown in FIG. 6, the support 400 may include a first seating part 410 on which the recessed part 210 constituting the content extruding member 200 is seated, and a second seating part 420 on which the lower end portion of the pressure changing part 220 is seated. Here, the second seating part 420 may be formed to surround the outer circumferential surface of the first seating part 410. Also, the first seating part 410 may have a seating groove 411 formed on the central portion of the first seating part 410 so that the lower end of the rubber tip 230 can be seated on the seating groove 411.

The support 400 may be configured to make contact with the whole of the lower end portion of the content extruding member 200 when the content extruding member 200 descends to the bottom surface of the container body 100. Thus, the residual contents that are unused and abandoned in the container body 100 can be minimized.

Since a process of discharging contents of an extrusion-type cosmetic container according to another exemplary embodiment of the present invention is similar to that of the previous embodiment, a detailed description thereof will be omitted herein.

As described above, optimal embodiments have been disclosed in the drawings and the specification. Although specific terms have been used herein, these are only intended to describe the present invention and are not intended to limit the meanings of the terms or to restrict the scope of the present invention as disclosed in the accompanying claims. Therefore, those skilled in the art will appreciate that various modifications and other equivalent embodiments are possible from the above embodiments. Therefore, the scope of the present invention should be defined by the technical spirit of the accompanying claims.

What is claimed is:

1. An extrusion-type cosmetic container comprising:

a container body storing contents;

a content extruding member disposed over contents inside the container body, the content extruding member configured to descend responsive to pressurization of a user while adhering closely to an inner circumferential surface of the container body, and having an outlet hole for discharging contents stored in the container body, wherein the content extruding member comprises a rubber tip that opens the outlet hole responsive to a pressure applied by the contents;

a cap coupled to an upper portion of the container body to cover the container body; and a support coupled to a lower portion of the container body and closing a lower end portion of the container body, wherein the content extruding member comprises:

a recessed part having a dish-like shape, an upper end portion of which is recessed in a downward direction so that contents are discharged to a top surface of the recessed part; and a pressure changing part that changes an internal pressure of the container body when the content extruding member descends responsive to the pressurization of the user, wherein the support comprises an upper end portion formed to have a shape corresponding to a lower end portion of the content extruding member so as to make contact with a whole of the lower end portion of the content extruding member when the content extruding member descends to a bottom surface of the container body, the support further comprising: a first seating part seated with the recessed part of the content extruding member and having a seating groove formed on a central portion of the first seating part so that a lower end of the rubber tip is seated on the seating groove; and a second seating part surrounding an outer circumferential surface of the first seating part, the second seating part seated with a lower end portion of the pressure changing part, and separated from an inner wall of the container body.

* * * * *